United States Patent [19]

Schär

[11] Patent Number: 4,647,173

[45] Date of Patent: Mar. 3, 1987

[54] APPARATUS FOR THE LIQUID-PROCESSING OF LIGHT-SENSITIVE SHEET MATERIAL

[75] Inventor: Meinrad Schär, Marly, Switzerland

[73] Assignee: Ciba-Geigy Ag, Basel, Switzerland

[21] Appl. No.: 826,031

[22] Filed: Feb. 4, 1986

[30] Foreign Application Priority Data

Feb. 12, 1985 [CH] Switzerland ..... 618/85
Aug. 20, 1985 [CH] Switzerland ..... 3579/85

[51] Int. Cl.[4] ..... G03D 5/00

[52] U.S. Cl. ..... 354/319; 354/324; 134/122 P

[58] Field of Search ..... 354/319, 320, 321, 322, 354/324; 134/64 P, 122 P

[56] References Cited

U.S. PATENT DOCUMENTS 3,610,131 10/1971 Frick et al. ..... 134/122 P
3,636,925 1/1972 Reuter et al. ..... 118/637
3,641,911 2/1972 Aelterman et al. ..... 134/64 P
3,683,780 8/1972 Edelman et al. ..... 134/122 P
3,988,756 10/1976 Wick et al. ..... 354/319

FOREIGN PATENT DOCUMENTS 0105833 4/1984 European Pat. Off. .
2104404 of 1972 France .
1276383 of 1972 United Kingdom .

*Primary Examiner*—A. A. Mathews
*Attorney, Agent, or Firm*—Harry Falber

[57] ABSTRACT

An apparatus for liquid-processing light-sensitive sheets comprises a processing dish preferably with a horizontal intermediate bottom. The upper side of the intermediate bottom constitutes the lower, and the underside of a lid covering the dish the upper, wall of a passage-gap through which the sheets are transported by pairs of conveying-and-squeezing rollers. The downstream dish sidewall, taken in sheet-transportation direction, is provided near its foot with a horizontal row of injection-nozzles for processing liquid. The dish sidewall opposite the nozzle-bearing sidewall bears a horizontally extending ledge or appropriate flow-reversing configuration effecting 180° reversal of the direction of liquid flow from underneath the intermediate bottom to above the profiled bottom-surface and toward the nozzle-bearing sidewall, generating a liquid stream through the passage-gap in the sheet-transportation direction. The bottom surface possesses a profiling comprising gable roof tile-like faces extending transverse to the sheet-transportation direction.

18 Claims, 5 Drawing Figures

APPARATUS FOR THE LIQUID-PROCESSING OF LIGHT-SENSITIVE SHEET MATERIAL

BACKGROUND OF THE INVENTION

This invention relates to apparatus for the liquid-processing of light-sensitive sheet material being transported through the apparatus which comprises at least one processing dish, having sidewalls, lid means having an underside and covering such dish, at least one bottom-surface extending substantially parallel with and at a distance underneath said lid means, thus forming at least one passage-gap extending between the lid means underside and the bottom surface and being adapted for being passed by processing liquid in the same direction in which the sheet material is being transported through the apparatus, and means for transporting sheets of said sheet material successively through said passage gap.

The upper surface of the bottom wall of the processing dish may constitute the bottom-surface delimiting the said passage-gap below.

In preferred embodiments of such apparatus that bottom-surface is constituted by the upper side of an intermediate bottom element about which the processing liquid can be circulated. Such preferred embodiment of the apparatus is described, for instance, in the European Patent application No. 83-810,346.3, having the Publication No. 105,833. In this apparatus, the intermediate bottom element in the processing dish bears on its upper side, constituting the lower wall defining the sheet passage-gap, a pattern of slender upright pins. Thereby, conditions for the passage of liquid are to be provided throughout the gap which are as uniform as possible, thereby presenting the lowest possible flow resistance and avoiding the formation of preferential directions of flow of partial liquid streams.

OBJECTS AND SUMMARY OF THE INVENTION

It is an object of the invention to provide an apparatus of the above-described kind comprising an improved profiling of the bottom-surface forming the lower wall of the passage-gap, thereby substantially improving the homogeneity of the liquid flow through the passage-gap.

This object is obtained by providing an apparatus of the above-described kind in which the bottom-surface has an asymmetrical, gable roof-like profiling having the aspect of overlapping rows of roof tiles extending transverse to the direction of sheet-transportation either on the top face of the dish bottom wall or base-plate of the apparatus or, preferably, on the top face of an intermediate bottom element in the aforesaid processing dish.

Preferred embodiments of the apparatus according to the invention show one or several of the following advantageous features:

(a) The transversely extending profile tile faces facing upstream toward, i.e. opposing, the direction of sheet-transportation and liquid flow and a horizontal plane, or the general plane in which the sheet material is transported, enclose between them a smaller angle ($\alpha$), preferably of at most 60°, more preferedly of 5° to 30°, than the profile (tile) faces facing downstream, i.e. in the same direction in which the sheet material is transported and in which the liquid flows over the bottom-surface.

(b) The downstream-facing profile (tile) faces and the horizontal plane,—which can, for instance, be defined by the general plane in which the sheet material passes through the passage-gap,—enclose preferably an angle ($\beta$) of about 30° to 120°, and optimally of 45° to 90°.

(c) The crest formed by adjacent downstream and upstream profile (tile) faces of the profiling has preferably a height of about 1 to 10 mm, optionally about 2 to 5 mm above the deepest level of the next-adjacent groove.

(d) The internal width (D) of the passage-gap perpendicular to the said general plane in which the sheets pass therethrough is preferably 1 to 10 mm, and optionally 3 to 5 mm.

(e) The crest region between an upstream-facing and an adjacent downstream-facing profile face following downstream, i.e. in the direction of sheet-transportation, can be flattened to form a flat, horizontally extending intermediate top face.

(f) The length of such flat, horizontally extending top face, taken in the direction of sheet-transportation is preferably about one quarter to one half of the length of the upstream-facing profile face, and most preferredly about one third of that profile face, the surface of that horizontal top face being preferably polished, e.g. by fine grinding, lapping or the like.

(g) Small guiding elements can be provided at and protrude from the downstream edge or crest of a last profile (tile) face, for instance of the upstream one, taken in the direction of sheet-transportation; these guiding elements preferably extend beyond the downstream end of the intermediate bottom wall to the vicinity of a downstream end wall of the processing dish, passages for the flow of processing liquid being left free between these guiding elements.

BRIEF DESCRIPTION OF THE DRAWINGS

More features of the invention and further objects attained thereby will be apparent from the detailed description of the preferred embodiment of an apparatus according to the invention illustrated in the accompanying drawings in which.

DETAILED DESCRIPTION OF THE EMBODIMENTS SHOWN IN THE DRAWINGS

Figure 1:
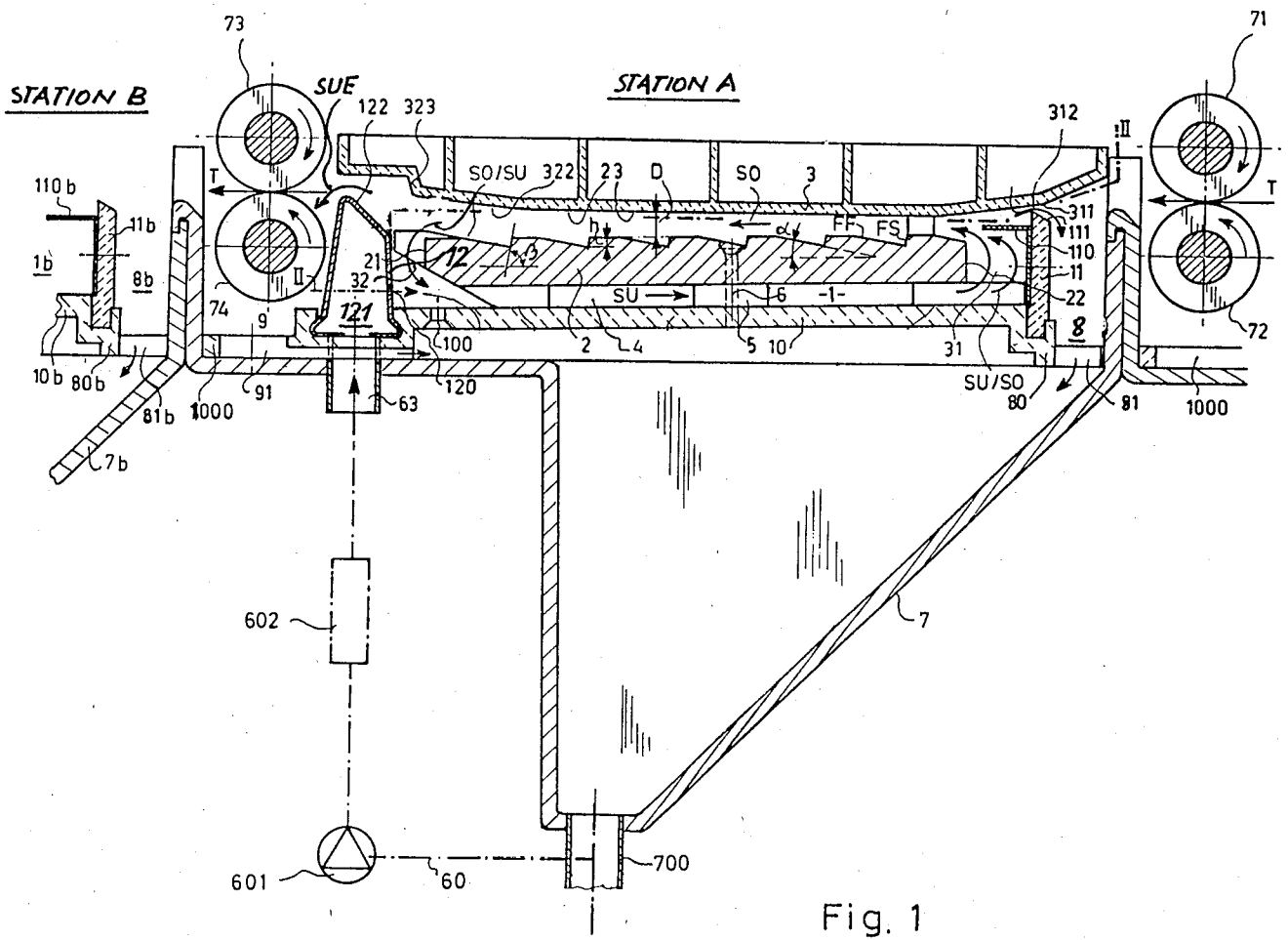
FIG. 1 is a longitudinal sectional view taken in a plane, perpendicular to the general plane in which sheet material is transported through the passage-gap of the said preferred embodiment, extending in the direction of transportation of the said sheet material.
Figure 2:
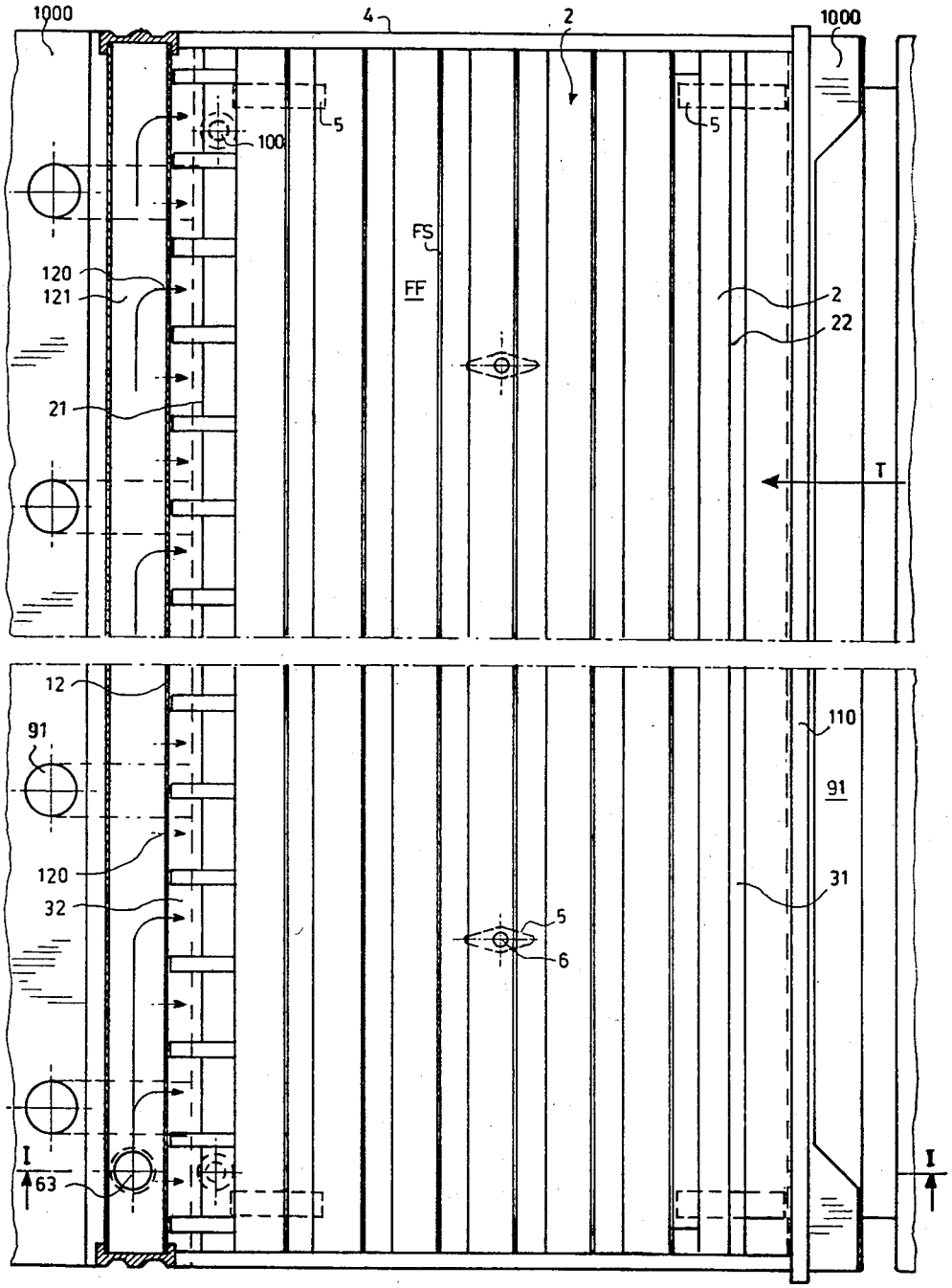
FIG. 2 is a sectional view taken in planes extending substantially parallel with the aforesaid general plane of sheet-transportation and indicated by II—II in FIG. 1.

In the figures of the Drawings, reference numeral 1 designates a processing dish and 2 an intermediate bottom. The intermediate bottom bears on its underside supporting end plates, feet or the like means 4 standing in the processing dish 1, as well as spacer members 5 in its central region, which rest on the dish bottom 10. The spacer members 5 are either firmly connected with the intermediate bottom 2 or they form an integral part of the same. Preferably, at least one of the spacer members 5 is anchored on the dish bottom 10 by means of a snap or screw connection 6. Thereby, the intermediate bottom 2 is safely secured on the dish bottom 10 against being lifted off by a strong liquid current passing underneath the intermediate bottom 2.

The transportation of the sheets to be treated is effected by conveying and squeezing roller pairs 71/72 and 73/74. Preferably, the upper roller, 71 and 73, of each pair is drivable directly by a motor, and the lower roller is freewheeling or is connected with the drive by means of an elastic transmission member.

Between the dish sidewalls 11 and 12, which extend transverse to the direction of sheet-transportation T, and the end or rim walls 21 and 22 of the intermediate bottom 2, there are left free terminal gaps 31 and 32, respectively. The sidewall 12 located downstream with regard to the direction of sheet-transportation T, is designed with a hollow profile, as a liquid distributor 121, and bears below the level of the intermediate bottom 2 a row of, for instance, 20 to 25 injection nozzles 120 for the processing liquid, which nozzles are distributed in horizontal arrangement over a distance of 250 mm. The sidewall 11 upstream with regard to the direction of sheet-transportation T is devised as an overflow for the liquid into a collecting channel 8. A collecting channel 9 is also arranged next to the downstream dish sidewall 12, which channel collects the liquid squeezed out from the passing sheets by the roller pair 73/74 and any liquid passing over the sidewall 12.

Only the first processing station has been completely shown in the drawings. A complete apparatus ordinarily comprises several, in particular three or four stations arranged in series, for instance, in the case of the silver bleach process, firstly a developing station, and next-following one or two bleaching stations and finally a fixing station. All stations are built in an identical manner. Only an upstream portion of the processing dish lB including the upstream dish sidewall llB and the associated collecting channel 8B of the second processing station B is therefore shown in FIG. 1.

As indicated in FIG. 1, all stations are mounted on a common base-plate 1000 which comprises in a continuous manner the bottom walls 10, lOB etc. of the processing dishes 1, lB etc., as well as all bottom walls 80, 90, 80B etc. of the collecting channels 8, 9, 8B, respectively. Apart from the first roller pair 71/72, each of the following roller pairs 73/74 with the exception of the last pair 73/74 (not shown) is common to two successive processing stations.

Underneath the processing dish 1 and the collecting channels 8 and 9, there is arranged at the base-plate 1000 a storage-and-buffer vessel 7 which is open at the top and the upper rim of which is firmly connected with the underside of the base-plate by gluing or welding. The volume ratio between the storage and buffer vessel 7 and the processing dish 1 amounts to about 1.5 to 2.5, and is preferably about 1.8.

The collecting channels 8 and 9 are provided with bottom discharge outlets 81 and 91, respectively through which liquid can flow into the vessel 7. The reference numeral 70 designates a vent hole for the vessel 7, and 100 designates discharge openings for the processing dish 1.

The sidewalls of the storage-and-buffer vessel 7 are devised to converge downwardly in the shape of a funnel. From the lowermost point of the vessel 7 a conduit 60 leads to the suction side of a circulating pump 601 whose pressure side is connected with a liquid distributor 121 via a thermostatically controlled heater 602 and a conduit 63. Moreover, a check valve-controlled bottom discharge outlet 700 is provided at that lowermost point.

The stations succeeding the first, above-described one in the direction of sheet-transportation T are provided in turn each with the same arrangement of a storage-and-buffer vessel and a circulating pump etc. In FIG. 1 there is only shown a wall of the vessel and its vent hole, and one of the discharge openings of the processing dish, and these parts have been designated correspondingly with 7B, 70B and lOOB, respectively.

Preferably, in analogy with the common base plate 1000, the storage and buffer vessels 7, 7B etc. of all stations are constituted by a single, integral building element whose upper rim faces are glued or welded to the base plate 1000.

Liquid is pressure-pumped by means of the circulating pump 601 via the thermostatically controlled heater 602 and via the distributor 121 to liquid-feeding nozzles 120 and through these into the processing dish 1. Excess liquid flowing over and down the outside of the dish sidewalls 11 and 12 is led via the collecting channels 8 and 9 to the storage-and-buffer vessel 7 and is returned from there to the pump 601. The discharge openings 100 are dimensioned sufficiently narrow to permit only a small fraction of the quantity of liquid fed through the nozzles 120 to run off during operation.

The entire circulating system, and in particular its pump 601 and the cross-sectional areas of the liquid-feeding nozzles 120 are so dimensioned that the liquid enters the processing dish at a flow rate of at least 0.5 m/sec and preferably at about 1 to 3 m/sec. The liquid-feeding nozzles 120 preferably have a diameter of about 1 to 2 mm, and optimally of 1.5 mm, and are arranged at a mutual distance of 10 to 30 mm, and optimally about 20 mm, in the lower quarter of the dish sidewall. Preferably, the pump output and thereby the feeding flow rate are adjustably controlled.

The upstream-located sidewall 11 of the processing dish 1 is shaped in a manner such that the liquid which flows against it in the lower sidewall part is deflected upwardly and its direction of flow is reversed. For this purpose, the wall 11 as a whole can be correspondingly shaped, i.e. convexly on its liquid-contacted, and concavely on its outer side. In FIG. 1, however, this wall is shown to be planar and provided, above the level of the intermediate bottom 2, with a horizontally protruding direction-changing ledge 110. This ledge can be glued or welded to the sidewall 11 or molded integral therewith. The ledge 110 projects into the dish 1 sufficiently to have its longitudinal edge located vertically spaced above and shortly before or behind the upstream rim of the intermediate bottom element.

Due to the liquid being fed through the liquid-feeding nozzles 120 into the dish 1 at a relatively high velocity, there is generated below the intermediate bottom 2 a string liquid current SU in a direction opposite the direction of sheet-transportation T. This current is deflected at the oppositely located dish sidewall 11 upwardly and with a major portion thereof to stream above the intermediate bottom in the direction of sheet-transportation T and back toward the sidewall 12. This return-flow portion is symbolized by an arrow SO. The liquid flowing back above the intermediate bottom 2 and in the direction of sheet-transportation T is drawn downwardly at the sidewall 12, due to the strong ejector effect of the liquid being ejected from the liquid-feeding nozzles 120 into the dish, and is accelerated again back toward the opposite dish sidewall. The reversal of the flow direction from below upwardly is symbolized by the arrow SU/SO and the reversal from above downwardly correspondingly by the arrow SO/SU. A portion of the liquid which is symbolized by an arrow SUE, flows in particular over the top and down the outside of the dish sidewall 12. The major portion of the liquid circulates about the intermediate bottom 2 (counterclockwise in FIG. 1), the liquid flow being generated and continuously maintained by the overflowing liquid stream which is recirculated by the pump 601, and by the ejector effect caused by the liquid being pressed through the nozzles 120.

The upper surface of the intermediate bottom 2 is constituted by an asymmetrically gable roof-like profile extending transversely to the direction of sheet-transportation T. The faces FF of this profile, facing in a direction opposed to the transportation direction T are of relatively small inclination and enclose, together with a horizontal plane indicated by a dashed line, an angle $\alpha$ of at most 60°; preferably, however, of only 5° to 30°. The adjoining faces FS, however, are inclined more steeply, as shown in the drawings, and enclose with the horizontal plane an angle $\beta$ of 30° to 120°, and preferably of 45° to 90°. The height h of the crest of the profiling amounts in practice to about 1 to 10 mm, and preferably to 2 to 5 mm. This arrangement of the profiled bottom-surface together with the underside of the dish lid 3 forms the passage-gap D. Due to the effect of the described profiling of the bottom-surface, there is achieved a homogeneous through-flow of the liquid through the passage-gap D, and at the same time a satisfactory passage of the sheets therethrough is guaranteed. The width of the gap D amounts to about 3 to 10 mm, and preferably to about 7 mm, and can be devised to be changeable or selectively adjustable.

Figure 3:
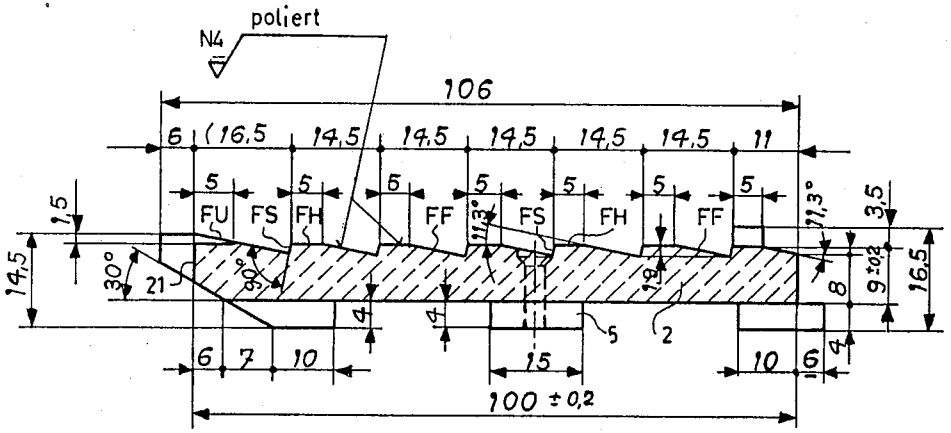
FIG. 3 is a longitudinal sectional view of an intermediate bottom element taken in a similar plane as FIG. 1, but of another embodiment having a somewhat different profiling of the upper surface thereof.
Figures 4, 5:
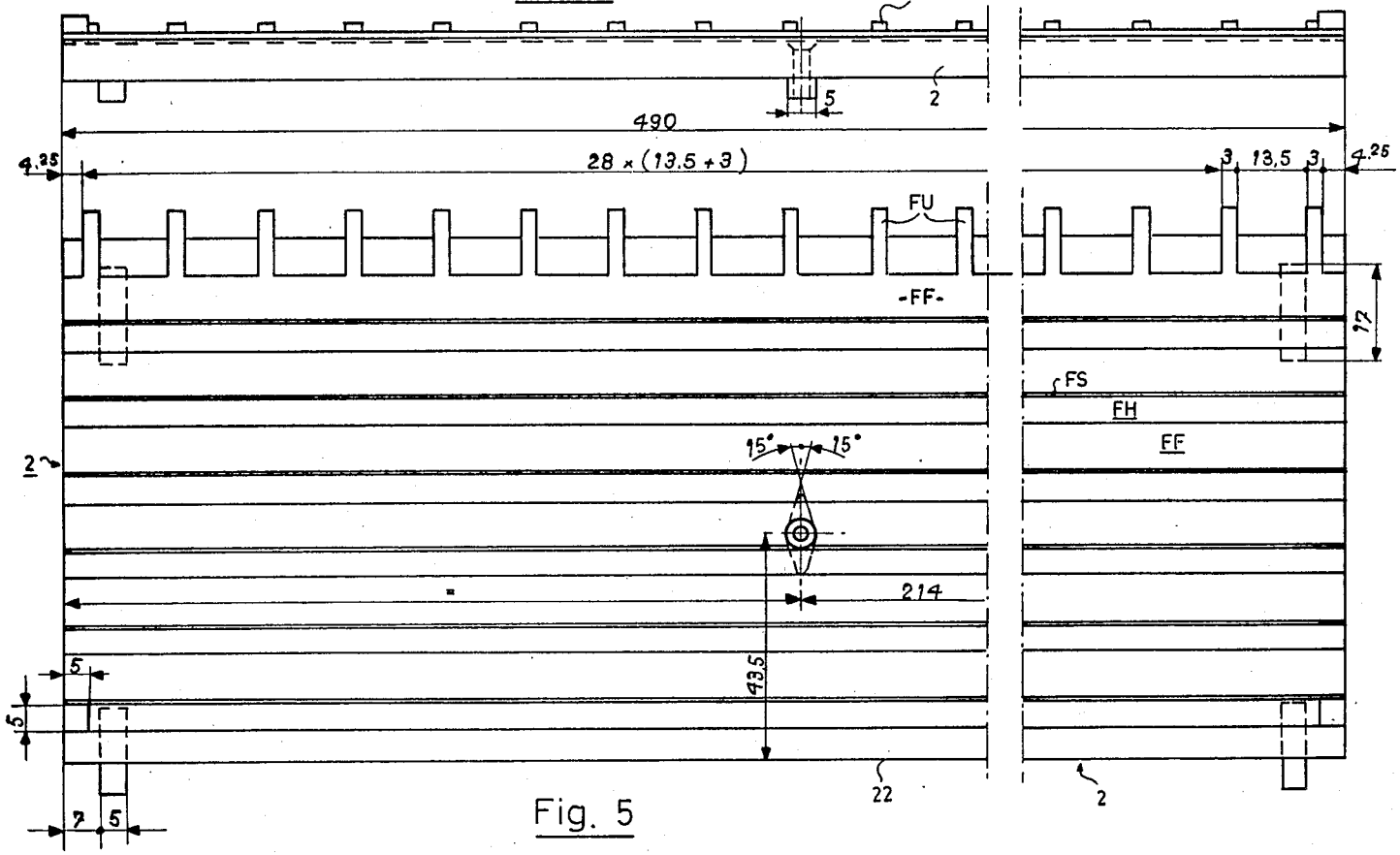
FIG. 4 is a sectional view of the same embodiment of an intermediate bottom element as shown in FIG. 3, but taken in a plane extending perpendicularly to that of FIG. 3.
FIG. 5 is a top view of the embodiment of an intermediate bottom element shown in FIG. 3.

In the embodiment of the intermediate bottom element illustrated in FIGS. 3 to 5, a horizontally extending face FH having preferably a polished surface, is interposed between the gently sloped upstream-facing profile face FF and the steeply inclined downstream-facing profile face FS. Taken in the direction of sheet-transportation, the length of this interposed face FH amounts to one quarter to one half, and preferably to one third of the length of the gently sloped face FF.

At the last profile face crest, taken in the direction of sheet transportation, there are provided guiding elements FU which extend beyond the downstream end 21 of the intermediate bottom 2 toward and close to the downstream dish sidewall 12. These guiding elements FU appear to be quite narrow, especially when regarded from above (FIG. 5), so that they do not impair the liquid flow SO/SU. They have approximately the same angle of ascent as the upstream-facing profile faces FF and improve the guidance of the sheets in the exiting region of the dish 1.

The entry and exit regions of the passage-gap D are designated hereinafter as sheet-entry gap and sheet-exit gap and are formed, respectively, by the upper edges of the sidewalls 11 and 12, and oppositely located guiding faces of the lid 3. In this case, the rim of dish sidewall 11 located at the sheet entry side is inwardly and upwardly tapered at an angle of about 20° C. to 40°, and preferably of about 30°. The lid 3 is provided at the sheet-entry gap with a guiding face 311 being inclined downwardly in the direction of sheet-transportation, and is located exactly opposite the tapered dish rim face 111, enclosing with the latter an angle of about 30° to 60° and having a visible transition zone 312 in the shape of a flat edge via-à-vis the adjacent flatter, less inclined guiding face of the lid. Thereby, there is achieved a wetting line, vertical with regard to the sheet-transporting direction T, which is as straight as possible.

The dish rim on the side of the sheet exit is tapered analogous, in the sheet-exiting direction T, ascending at an angle of about 20° to 60°, and preferably about 45°, and with rounded edges to form an upwardly sheet-guiding face 122. The lid 3 is further provided in the sheet-exiting region with an outwardly and gently upwardly tapered guiding face 322 which ends in a recessed step 323 in the lid underside. This step 323 is located between the exit-side (downstream) end of the intermediate bottom 2 and the guiding face 122 of the dish sidewall 12. This achieves termination of the contact between the liquid stream in the dish 1 and the sheet in an exactly defined straight line extending at right angle with the direction of sheet-transportation, and at least greatly reduces the entrainment of liquid and air bubbles by the treated sheet.

The asymmetrical gable-roof configuration of the lower guiding (bottom) surface of the passage-gap could also be designated as sawtooth-like profile. The transition zones or edges between the various profile faces can be rounded and the faces themselves need not be strictly planar. Generally, the profiling can be a kind of corrugation with flatter upstream-facing and steeper downstream-facing slopes.

With regard to the operation of the apparatus, it will be understood that the sheets are gripped between the conveying and squeezing rollers 71 and 72 and are pushed by the latter through the passage-gap D and then seized by the next-following rollers 73 and 74 and pulled by them. All roller pairs are driven absolutely synchronously.

I claim:

1. Apparatus for the liquid-processing of light-sensitive sheet material being transported through the apparatus which comprises at least one processing dish having sidewalls, lid means having an underside and covering such dish, at least one bottom-surface extending substantially parallel with and at a distance underneath said lid means, thus forming at least one passage-gap extending between said lid means underside and said bottom surface and being adapted for being passed by processing liquid in the same direction in which said sheet material is being transported through said apparatus, said bottom surface constituting the bottom wall of said passage-gap and having an asymmetrical gable roof-like profiling, having the aspect of overlapping rows of roof tile faces extending transverse to the direction of sheet transportation and comprising profile faces facing upstream against the direction of sheet transportation, and profile faces facing downstream in said direction of sheet transportation.

2. The apparatus of claim 1, further comprising an intermediate bottom element located in said dish and having an upper side constituting said gable roof-like profiled bottom surface.

3. The apparatus of claim 1 or 2, further comprising liquid-injecting means adapted for causing processing liquid to circulate in said dish in a manner such that liquid flows over said gable roof-like profiled bottom surface through said passage gap in the same direction as said sheet material is being transported therethrough.

4. The apparatus of claim 3, wherein those roof tile faces being profile faces facing upstream, against the direction of sheet transportation and liquid flow through said passage gap, enclose with a horizontal plane an angle smaller than that angle which is enclosed between those roof tile faces being more steeply inclined profile faces facing downstream, in the same direction as said sheet transportation and liquid flow, and said horizontal plane.

5. The apparatus of claim 4, wherein those profile faces facing upstream, against the direction of sheet transportation and liquid flow, enclose with a horizontal plane an angle $\alpha$ of at most 60°.

6. The apparatus of claim 5, wherein said angle $\alpha$ is from about 5° to 30°.

7. The apparatus of claim 3, wherein those profile faces facing downstream, in the same direction of sheet transportation, enclose with a horizontal plane an angle $\beta$ of about 30° to 120°.

8. The apparatus of claim 7, wherein said angle $\beta$ is from 45° to 90°.

9. The apparatus of claim 3, wherein alternatingly said upstream-facing and next-following downstream-facing profile faces form crests between them, and said downstream-facing and next-following upstream-facing profile faces form grooves between them, and the height of each such crest above the deepest level of the respective adjacent groove amounts to about 1 to 10 mm.

10. The apparatus of claim 9, wherein said height ranges from about 2 to 5 mm.

11. The apparatus of claim 1 or 2, wherein the internal width of said passage-gap taken perpendicularly to that general plane in which said sheet material passes therethrough, is about 1 to 10 mm.

12. The apparatus of claim 11, wherein said internal width is about 3 to 5 mm.

13. The apparatus of claim 4, wherein said profiling comprises a flat, substantially horizontally extending intermediate top face between each upstream-facing profile face and the next-adjacent downstream-facing profile face following in downstream direction.

14. The apparatus of claim 13, wherein the length of said intermediate top face, taken in the direction of sheet transportation, is about one fourth to one half the length of said upstream-facing profile face.

15. The apparatus of claim 14, wherein said length of said intermediate top face is about one third of the length of said upstream-facing profile face.

16. The apparatus of claim 13, wherein said intermediate top face is polished.

17. The apparatus of claim 4, further comprising guiding elements protruding in the direction of sheet transportation beyond the last one of said downstream-facing profile faces on said intermediate bottom element, and extending toward and close to a downstream one of said dish sidewall means.

18. The apparatus of claim 1, wherein the length of each upstream-facing profile face, taken in the direction of sheet transportation, is substantially greater than the length of each downstream-facing profile face taken in the same direction.

* * * * *